US005527560A

United States Patent [19]

Fereshtehkhou et al.

[11] Patent Number: 5,527,560

[45] Date of Patent: *Jun. 18, 1996

[54] PROCESS FOR MAKING TISSUE PAPER TREATED WITH NONIONIC SOFTENERS THAT ARE BIODEGRADABLE

[76] Inventors: Saeed Fereshtehkhou; Larry N. Mackey; Dean V. Phan, all of 6300 Center Hill Rd., Cincinnati, Ohio 45224

[ * ] Notice: The term of this patent shall not extend beyond the expiration date of Pat. No. 5,385,642.

[21] Appl. No.: 517,785

[22] Filed: Aug. 22, 1995

Related U.S. Application Data

[62] Division of Ser. No. 238,196, May 4, 1994, Pat. No. 5,494,731, which is a continuation of Ser. No. 936,438, Aug. 27, 1992.

[51] Int. Cl.[6] ..... B05D 5/00

[52] U.S. Cl. ..... 427/288; 162/112; 162/135; 162/158; 162/179; 162/183; 427/428

[58] Field of Search ..... 162/42, 135, 158, 162/179, 183; 427/384, 288, 428

[56] References Cited

U.S. PATENT DOCUMENTS

| | | | |
|---|---|---|---|
| 4,103,047 | 7/1978 | Zaki et al. | 427/242 |
| 4,351,699 | 9/1982 | Osborn | 162/112 |
| 4,959,125 | 9/1990 | Spendel | 162/158 |
| 5,385,642 | 1/1995 | Phan et al. | 162/158 X |

*Primary Examiner*—Michael Lusignan
*Attorney, Agent, or Firm*—Eric W. Guttag; Carl J. Roof; E. Kelly Linman

[57] ABSTRACT

Tissue papers, in particular pattern densified tissue papers, having an enhanced tactile sense of softness when treated with certain nonionic softeners are disclosed. These nonionic softeners are biodegradable and comprise sorbitan esters, ethoxylated/propoxylated versions of these sorbitan esters, or mixtures thereof. The softener is typically applied from an aqueous dispersion or solution thereof to at least one surface of the dry tissue paper web.

30 Claims, 2 Drawing Sheets

T
P-2
49.74°C
PM-2
32.36°C
51.11J/g
OM-2
P-1
PM-1
9.92°C
-1.94°C
11.25J/g
OM-1
Heat Flow (W/g)
Temperature (°C)
0.0
-0.5
-1.0
-1.5
-2.0
-2.5
-20
0
20
40
60
80
100

PROCESS FOR MAKING TISSUE PAPER TREATED WITH NONIONIC SOFTENERS THAT ARE BIODEGRADABLE

This is a divisional of application Ser. No. 08/238,196, filed May 4, 1994, now U.S. Pat. No. 5,494,731, which is a continuation of application Ser. No. 07/936,438, filed on Aug. 27, 1992.

TECHNICAL FIELD

This application relates to tissue papers, in particular pattern densified tissue papers, having an enhanced tactile sense of softness. This application particularly relates to tissue papers treated with certain nonionic softeners that are biodegradable.

BACKGROUND OF THE INVENTION

Paper webs or sheets, sometimes called tissue or paper tissue webs or sheets, find extensive use in modern society. These include such staple items as paper towels, facial tissues and sanitary (or toilet) tissues. These paper products can have various desirable properties, including wet and dry tensile strength, absorbency for aqueous fluids (e.g., wettability), low lint properties, desirable bulk, and softness. The particular challenge in papermaking has been to appropriately balance these various properties to provide superior tissue paper.

Although somewhat desirable for towel products, softness is a particularly important property for facial and toilet tissues. Softness is the tactile sensation perceived by the consumer who holds a particular paper product, rubs it across the skin, and crumples it within the hand. Such tactile perceivable softness can be characterized by, but is not limited to, friction, flexibility, and smoothness, as well as subjective descriptors, such as a feeling like velvet, silk or flannel. This tactile sensation is a combination of several physical properties, including the flexibility or stiffness of the sheet of paper, as well as the texture of the surface of the paper.

Stiffness of paper is typically affected by efforts to increase the dry and/or wet tensile strength of the web. Increases in dry tensile strength can be achieved either by mechanical processes to insure adequate formation of hydrogen bonding between the hydroxyl groups of adjacent papermaking fibers, or by the inclusion of certain dry strength additives. Wet strength is typically enhanced by the inclusion of certain wet strength resins, that, being typically cationic, are easily deposited on and retained by the anionic carboxyl groups of the papermaking fibers. However, the use of both mechanical and chemical means to improve dry and wet tensile strength can also result in stiffer, harsher feeling, less soft tissue papers.

Certain chemical additives, commonly referred to as debonding agents, can be added to papermaking fibers to interfere with the natural fiber-to-fiber bonding that occurs during sheet formation and drying, and thus lead to softer papers. These debonding agents are typically cationic and have certain disadvantages associated with their use in softening tissue papers. Some low molecular weight cationic debonding agents can cause excessive irritation upon contact with human skin. Higher molecular weight cationic debonding agents can be more difficult to apply at low levels to tissue paper, and also tend to have undesirable hydrophobic effects on the tissue paper, e.g., result in decreased absorbency and particularly wettability. Since these cationic debonding agents operate by disrupting interfiber bonding, they can also decrease tensile strength to such an extent that resins, latex, or other dry strength additives can be required to provide acceptable levels of tensile strength. These dry strength additives not only increase the cost of the tissue paper but can also have other, deleterious effects on tissue softness. In addition, many cationic debonding agents are not biodegradable, and therefore can adversely impact on environmental quality.

Mechanical pressing operations are typically applied to tissue paper webs to dewater them and/or increase their tensile strength. Mechanical pressing can occur over the entire area of the paper web, such as in the case of conventional felt-pressed paper. More preferably, dewatering is carried out in such a way that the paper is pattern densified. Pattern densified paper has certain densified areas of relatively high fiber density, as well as relatively low fiber density, high bulk areas. Such high bulk pattern densified papers are typically formed from a partially dried paper web that has densified areas imparted to it by a foraminous fabric having a patterned displacement of knuckles. See, for example, U.S. Pat. No. 3,301,746 (Sanford et al), issued Jan. 31, 1967; U.S. Pat. No. 3,994,771 (Morgan et al), issued Nov. 30, 1976; and U.S. Pat. No. 4,529,480 (Trokhan), issued Jul. 16, 1985.

Besides tensile strength and bulk, another advantage of such patterned densification processes is that ornamental patterns can be imprinted on the tissue paper. However, an inherent problem of patterned densification processes is that the fabric side of the tissue paper, i.e. the paper surface in contact with the foraminous fabric during papermaking, is sensed as rougher than the side not in contact with the fabric. This is due to the high bulk fields that form, in essence, protrusions outward from the surface of the paper. It is these protrusions that can impart a tactile sensation of roughness.

The softness of these compressed, and particularly patterned densified tissue papers, can be improved by treatment with various agents such as vegetable, animal or synthetic hydrocarbon oils, and especially polysiloxane materials typically referred to as silicone oils. See Column 1, lines 30–45 of U.S. Pat. No. 4,959,125 (Spendel), issued Sep. 25, 1990. These silicone oils impart a silky, soft feeling to the tissue paper. However, some silicone oils are hydrophobic and can adversely affect the surface wettability of the treated tissue paper, i.e. the treated tissue paper can float, thus causing disposal problems in sewer systems when flushed. Indeed, some silicone softened papers can require treatment with other surfactants to offset this reduction in wettability caused by the silicone. See U.S. Pat. No. 5,059,282 (Ampulski et al), issued Oct. 22, 1991.

Besides silicones, tissue paper has been treated with cationic, as well as noncationic, surfactants to enhance softness. See, for example, U.S. Pat. No. 4,959,125 (Spendel), issued Sep. 25, 1990; and U.S. Pat. No. 4,940,513 (Spendel), issued Jul. 10, 1990, that disclose processes for enhancing the softness of tissue paper by treating it with noncationic, preferably nonionic, surfactants. However, the '125 patent teaches that greater softness benefits are obtainable by the addition of the noncationic surfactants to the wet paper web; the '513 patent only discloses the addition of noncationic surfactants to a wet web. In such "wet web" methods of addition, the noncationic surfactant can potentially migrate to the interior of the paper web and completely coat the fibers. This can cause a variety of problems, including fiber debonding that leads to a reduction in tensile strength of the paper, as well as adverse affects on paper wettability if the noncationic surfactant is hydrophobic or not very hydrophilic.

Tissue paper has also been treated with softeners by "dry web" addition methods. One such method involves moving the dry paper across one face of a shaped block of wax-like softener that is then deposited on the paper surface by a rubbing action. See U.S. Pat. No. 3,305,392 (Britt), issued Feb. 21, 1967 (softeners include stearate soaps such as zinc stearate, stearic acid esters, stearyl alcohol, polyethylene glycols such as Carbowax, and polyethylene glycol esters of stearic and lauric acids). Another such method involves dipping the dry paper in a solution or emulsion containing the softening agent. See U.S. Pat. No. 3,296,065 (O'Brien et al), issued Jan. 3, 1967 (aliphatic esters of certain aliphatic or aromatic carboxylic acids as the softening agent). A potential problem of these prior "dry web" addition methods is that the softening agent can be applied less effectively, or in a manner that could potentially affect the absorbency of the tissue paper. Indeed, the '392 patent teaches as desirable modification with certain cationic materials to avoid the tendency of the softener to migrate. Application of softeners by either a rubbing action or by dipping the paper would also be difficult to adapt to commercial papermaking systems that run at high speeds. Furthermore, some of the softeners (e.g., the pyromellitate esters of the '065 patent), as well as some of the co-additives (e.g., dimethyl distearyl ammonium chloride of the '532 patent), taught to be useful in these prior "dry web" methods are not biodegradable.

Accordingly, it would be desirable to be able to soften tissue paper, in particular high bulk, pattern densified tissue papers, by a process that: (1) uses a "dry web" method for adding the softening agent; (2) can be carried out in a commercial papermaking system without significantly impacting on machine operability; (3) uses softeners that are nontoxic and biodegradable; and (4) can be carried out in a manner so as to maintain desirable tensile strength, absorbency and low lint properties of the tissue paper.

DISCLOSURE OF THE INVENTION

The present invention relates to softened tissue paper having a nonionic softener on at least one surface thereof. Suitable nonionic softeners comprise a nonionic surfactant selected from sorbitan esters, ethoxylated sorbitan esters, propoxylated sorbitan esters, mixed ethoxylated/propoxylated sorbitan esters, and mixtures thereof. The softener is present in an amount of from about 0.1 to about 3% by weight of the dried tissue paper.

The present invention further relates to a process for making these softened tissue papers. This process comprises the step of treating at least one surface of a dried tissue paper web with the softener. In other words, the process of the present invention is a "dry web" addition method. This process is carried out in a manner such that from about 0.1 to about 3% of the softener by weight of the dry tissue paper web is applied to the surface thereof.

Tissue paper softened according to the present invention has a soft and velvet-like feel. It is especially useful in softening high bulk, pattern densified tissue papers, including tissue papers having patterned designs. Surprisingly, even when the softener is applied only to the smoother (i.e. wire) side of such pattern densified papers, the treated paper is still perceived as soft.

The present invention can be carried out in a commercial papermaking system without significantly impacting on machine operability, including speed. The softeners used in the present invention also have environmental safety (i.e. are nontoxic and biodegradable) and cost advantages, especially compared to prior softening agents used to treat tissue paper. The improved softness benefits of the present invention can also be achieved while maintaining the desirable tensile strength, absorbency (e.g., wettability), and low lint properties of the paper.

DETAILED DESCRIPTION OF THE INVENTION

A. Tissue Papers

Figure 1:
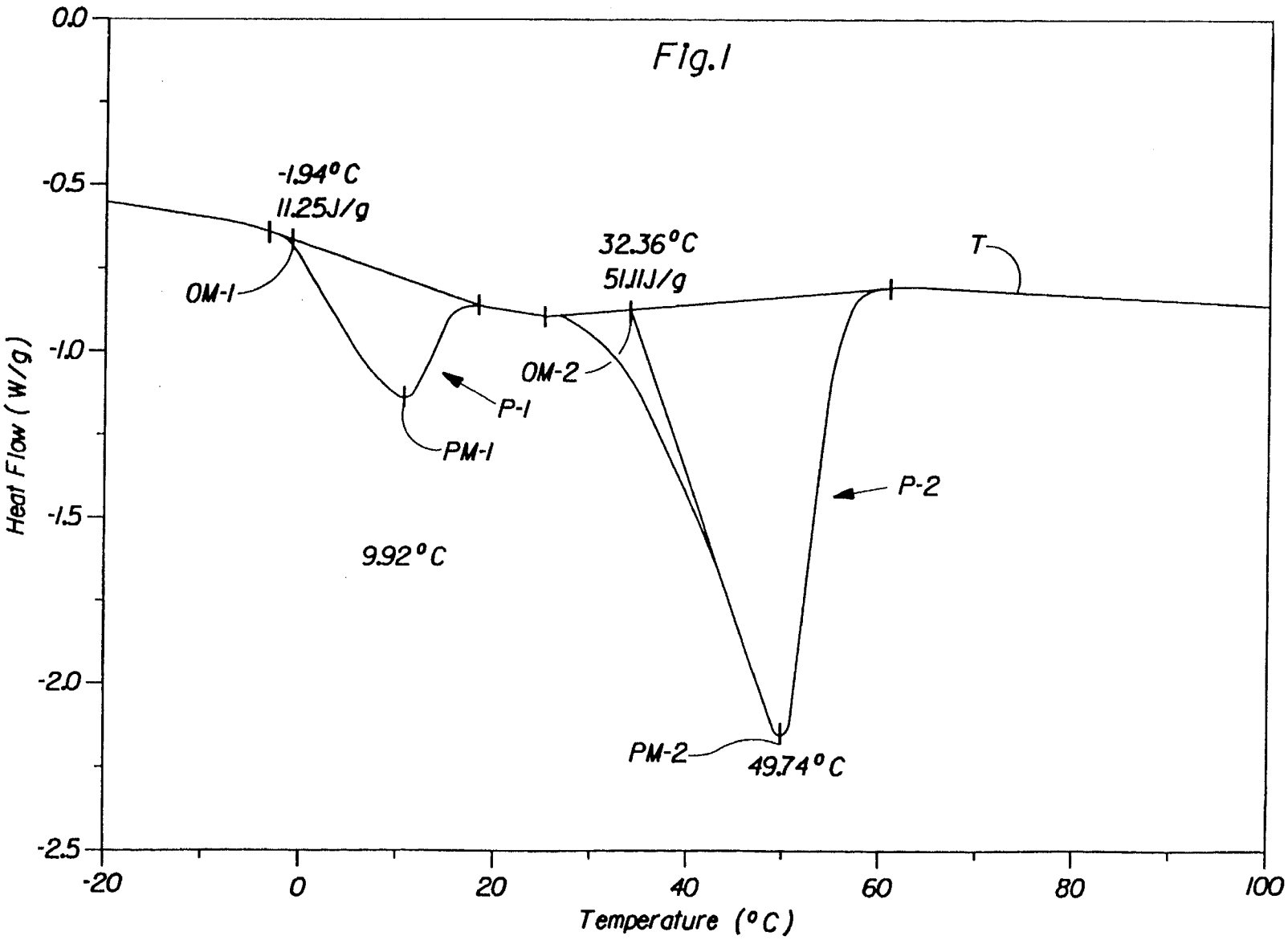
FIG. 1 is a DSC thermogram of a preferred softener system useful in the present invention.

The present invention is useful with tissue paper in general, including but not limited to conventionally felt-pressed tissue paper; high bulk pattern densified tissue paper; and high bulk, uncompacted tissue paper. The tissue paper can be of a homogenous or multi-layered construction; and tissue paper products made therefrom can be of a single-ply or multi-ply construction. The tissue paper preferably has a basis weight of between about 10 $g/m^2$ and about 65 $g/m^2$, and density of about 0.6 g/cc or less. More preferably, the basis weight will be about 40 $g/m^2$ or less and the density will be about 0.3 g/cc or less. Most preferably, the density will be between about 0.04 g/cc and about 0.2 g/cc. See Column 13, lines 61–67, of U.S. Pat. No. 5,059,282 (Ampulski et al), issued Oct. 22, 1991, which describes how the density of tissue paper is measured. (Unless otherwise specified, all amounts and weights relative to the paper are on a dry basis.)

Conventionally pressed tissue paper and methods for making such paper are well known in the art. Such paper is typically made by depositing a papermaking furnish on a foraminous forming wire, often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided from a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls. The dewatered web is then further pressed and dried by a steam drum apparatus known in the art as a Yankee dryer. Pressure can be developed at the Yankee dryer by mechanical means such as an opposing cylindrical drum pressing against the web. Multiple Yankee dryer drums can be employed, whereby additional pressing is optionally incurred between the drums. The tissue paper structures which are formed are referred to hereafter as conventional, pressed, tissue paper structures. Such sheets are considered to be compacted since the entire web is subjected to substantial mechanical compressional forces while the fibers are moist and are then dried while in a compressed state.

Pattern densified tissue paper is characterized by having a relatively high bulk field of relatively low fiber density and an array of densified zones of relatively high fiber density.

The high bulk field is alternatively characterized as a field of pillow regions. The densified zones are alternatively referred to as knuckle regions. The densified zones can be discretely spaced within the high bulk field or can be interconnected, either fully or partially, within the high bulk field. The patterns can be formed in a nonornamental configuration or can be formed so as to provide an ornamental design(s) in the tissue paper. Preferred processes for making pattern densified tissue webs are disclosed in U.S. Pat. No. 3,301,746 (Sanford et al), issued Jan. 31, 1967; U.S. Pat. No. 3,974,025 (Ayers), issued Aug. 10, 1976; and U.S. Pat. No. 4,191,609 (Trokhan) issued Mar. 4, 1980; and U.S. Pat. No. 4,637,859 (Trokhan) issued Jan. 20, 1987; all of which are incorporated by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones can be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Suitable imprinting carrier fabrics are disclosed in U.S. Pat. No. 3,301,746 (Sanford et al), issued Jan. 31, 1967; U.S. Pat. No. 3,821,068 (Salvucci et al), issued May 21, 1974; U.S. Pat. No. 3,974,025 (Ayers), issued Aug. 10, 1976; U.S. Pat. No. 3,573,164 (Friedberg et al.), issued Mar. 30, 1971; U.S. Pat. No. 3,473,576 (Amneus), issued Oct. 21, 1969; U.S. Pat. No. 4,239,065 (Trokhan), issued Dec. 16, 1980; and U.S. Pat. No. 4,528,239 (Trokhan), issued Jul. 9, 1985, all of which are incorporated by reference.

Preferably, the furnish is first formed into a wet web on a foraminous forming carrier, such as a Fourdrinier wire. The web is dewatered and transferred to an imprinting fabric. The furnish can alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure can be applied to induce impression of densified zones during initial dewatering, in a separate, subsequent process stage, or a combination thereof.

Uncompacted, nonpattern-densified tissue paper structures are described in U.S. Pat. No. 3,812,000 (Salvucci et al), issued May 21, 1974 and U.S. Pat. No. 4,208,459 (Becker et al), issued Jun. 17, 1980, both of which are incorporated by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least about 80%, and creping the web. Water is removed from the web by vacuum dewatering and thermal drying. The resulting structure is a soft but weak, high bulk sheet of relatively uncompacted fibers. Bonding material is preferably applied to portions of the web prior to creping.

Compacted non-pattern-densified tissue structures are commonly known in the art as conventional tissue structures. In general, compacted, non-pattern-densified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and softness.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, can also be utilized in combination with natural cellulosic fibers. One exemplary polyethylene fiber which can be utilized is Pulpex™, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereafter, also referred to as "hardwood") and coniferous trees (hereafter, also referred to as "softwood") can be utilized. Also useful in the present invention are fibers derived from recycled paper, which can contain any or all of the above categories as well as other non-fibrous materials such as fillers and adhesives used to facilitate the original papermaking.

In addition to papermaking fibers, the papermaking furnish used to make tissue paper structures can have other components or materials added thereto as can be or later become known in the art. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. No. 3,700,623 (Keim), issued Oct. 24, 1972, and U.S. Pat. No. 3,772,076 (Keim), issued Nov. 13, 1973, both of which are incorporated by reference. One commercial source of a useful polyamide-epichlorohydrin resins is Hercules, Inc. of Wilmington, Del., which markets such resins under the mark Kymeme® 557H.

Polyacrylamide resins have also been found to be of utility as wet strength resins. These resins are described in U.S. Pat. Nos. 3,556,932 (Coscia et al), issued Jan. 19, 1971, and 3,556,933 (Williams et al), issued Jan. 19, 1971, both of which are incorporated herein by reference. One commercial source of polyacrylamide resins is American Cyanamid Co. of Stanford, Conn., which markets one such resin under the mark Parez® 631NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins can also find utility in the present invention. In addition, temporary wet strength resins such as Caldas 10 (manufactured by Japan Carlit) and CoBond 1000 (manufactured by National Starch and Chemical Company) can be used in the present invention. It is to be understood that the addition of chemical compounds such as the wet strength and temporary wet strength resins discussed above to the pulp furnish is optional and is not necessary for the practice of the present invention.

In addition to wet strength additives, it can also be desirable to include in the papermaking fibers certain dry strength and lint control additives known in the art. In this regard, starch binders have been found to be particularly suitable. In addition to reducing linting of the finished tissue paper product, low levels of starch binders also impart a modest improvement in the dry tensile strength without imparting stiffness that could result from the addition of high levels of starch. Typically the starch binder is included in an amount such that it is retained at a level of from about 0.01 to about 2%, preferably from about 0.1 to about 1%, by weight of the tissue paper.

In general, suitable starch binders for the present invention are characterized by water solubility, and hydrophilicity. Although it is not intended to limit the scope of suitable starch binders, representative starch materials include corn starch and potato starch, with waxy corn starch known industrially as amioca starch being particularly preferred. Amioca starch differs from common corn starch in that it is entirely amylopectin, whereas common corn starch contains both amylopectin and amylose. Various unique characteristics of amioca starch are further described in "Amioca—The Starch From Waxy Corn", H. H. Schopmeyer, Food Industries, December 1945, pp. 106–108 (Vol. pp. 1476–1478).

The starch binder can be in granular or dispersed form, the granular form being especially preferred. The starch binder is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes. Other exemplary starch binders which can be used include modified cationic starches such as those modified to have nitrogen containing groups, including amino groups and methylol groups attached to nitrogen, available from National Starch and Chemical Company, (Bridgewater, N.J.), that have heretofore been used as pulp furnish additives to increase wet and/or dry strength.

B. Biodegradable Nonionic Softeners

Suitable nonionic softeners for use in the present invention are biodegradable. As used herein, the term "biodegradability" refers to the complete breakdown of a substance by microorganisms to carbon dioxide, water, biomass, and inorganic materials. The biodegradation potential can be estimated by measuring carbon dioxide evolution and dissolved organic carbon removal from a medium containing the substance being tested as the sole carbon and energy source and a dilute bacterial inoculum obtained from the supernatant of homogenized activated sludge. See Larson, "Estimation of Biodegradation Potential of Xenobiotic Organic Chemicals," *Applied and Environmental Microbiology,* Volume 38 (1979), pages 1153–61, which describes a suitable method for estimating biodegradability. Using this method, a substance is said to be readily biodegradable if it has greater than 70% carbon dioxide evolution and greater than 90% dissolved organic carbon removal within 28 days. The softeners used in the present invention meet such biodegradability criteria.

Another important aspect of the softeners used in the present invention is their melting properties. It is believed that the operative mechanism by which softeners used in the present invention work is as a result of surface lubrication of the tissue paper. Such surface lubrication is believed to require the softener active to begin melting at or below about body temperature, i.e. at about 37° C. Accordingly, suitable softeners for use in the present invention typically have, as measured by Differential Scanning Calorimetry (DSC), an onset of melting at or below about 37° C. Preferably, these softeners have an onset of melting at or below about 35° C.

As used herein, the term "onset of melting" refers to the point at which the softener begins to change from a solid to a liquid state. As measured by DSC, onset of melting occurs at the point of intersection of: (a) the tangent drawn at the point of greatest slope on the leading edge of the peak; and (b) the extrapolated base line of the DSC thermogram. See pages 807–808 of Wendlandt, *Thermal Analysis,* (3rd edition, 1986), which defines this point of intersection as the "extrapolated onset." What constitutes an onset of melting of the softener can be best understood by reference to FIG. 1. FIG. 1 represents a DSC thermogram of a preferred softener system comprising mixed sorbitan stearate esters (GLYCOMUL-S CG) and an ethoxylated aliphatic alcohol (NEODOL 23-6.5T) in about a 4:1 weight ratio. Referring to FIG. 1, the DSC thermogram identified by the letter T has two endothermic peaks P-1 and P-2 that represent the melting of two different phases of the softener system. The peak melt point (i.e., the highest point on the peak) is 9.92° C. (PM-1) and 49.74° C. (PM-2) for P-1 and P-2, respectively. The onset of melting for each of these peaks is −1.94° C. (OM-1) and 32.36° C. (OM-2), respectively. The onset of melting represented by OM-2 is the most important since P-2 represents the largest, predominant melting phase of the softener system. Indeed, for the purposes of the present invention, the onset of melting usually refers to that of the predominant melting phase, i.e. that phase having the largest peak area.

The onset of melting of softener systems used in the present invention can be determined by DSC as follows: A TA instruments DSC, Model 2910 (Controller 2000 with TA Operating System Software 8.5C) made by TA Instruments, Newcastle, Del. is used. The softener sample is placed in an open aluminum pan with an inverted lid and the weight recorded. The softener sample pan and a reference pan are then placed in the DSC cell. The cell containing the softener sample is cooled to −50° C., allowed to equilibrate, and then scanned from −50° C. to 225° C. at a rate of 20° C. per minute. A nitrogen purge flow of 0.0037 l./min is applied to the cell. The resulting DSC thermogram records the onset of melting point, the peak melt point, and heat of fusion for each of the endothermic peaks, as is shown in FIG. 1.

Nonionic softeners suitable for use in the present invention comprise certain nonionic surfactants. These nonionic surfactants include the sorbitan esters, preferably the sorbitan esters of the $C_{12}$–$C_{22}$ fatty acids, most preferably the sorbitan esters of $C_{12}$–$C_{22}$ saturated fatty acids. Because of the manner in which they are typically manufactured, these sorbitan esters usually comprise mixtures of mono-, di-, tri-, etc. esters. Representative examples of suitable sorbitan esters include the sorbitan laurates (e.g., SPAN 20), sorbitan myristates, sorbitan palmitates (e.g., SPAN 40), sorbitan stearates (e.g., SPAN 60), and sorbitan behenates, that comprise one or more of the mono-, di- and tri-ester versions of these sorbitan esters, e.g., sorbitan mono-, di- and tri-laurate, sorbitan mono-, di- and tri-myristate, sorbitan mono-, di- and tri-palmitate, sorbitan mono-, di- and tri-stearate, sorbitan mono-, di and tri-behenate, as well as mixed coconut fatty acid sorbitan mono-, di- and tri-esters, and mixed tallow fatty acid sorbitan mono-, di- and tri-esters. Mixtures of different sorbitan esters can also be used, such as sorbitan palmitates with sorbitan stearates. Particularly preferred sorbitan esters are the sorbitan stearates, typically as a mixture of mono-, di- and tri-esters (plus some tetraester) such as SPAN 60, and sorbitan stearates sold under the trade name GLYCOMUL-S by Lonza, Inc.

Nonionic surfactants suitable in the softener systems of the present invention can also include ethoxylated, propoxylated, and mixed ethoxylated/propoxylated versions of these sorbitan esters. The ethoxylated/propoxylated versions of these sorbitan esters have 1 to 3 oxyethylene/oxypropylene moieties and typically an average degree of ethoxylation/propoxylation of from 1 to about 20. Representative examples of suitable ethoxylated/propoxylated sorbitan esters include ethoxylated/propoxylated sorbitan laurates, ethoxylated/propoxylated sorbitan myristates, ethoxylated/propoxylated sorbitan palmitates, ethoxylated/propoxylated sorbitan stearates, and ethoxylated/propoxylated sorbitan behenates, where the average degree of ethoxylation/propoxylation per sorbitan ester is preferably from about 2 to about 20, more preferably from about 2 to about 10, most preferably from about 2 to about 6. Ethoxylated versions of these sorbitan esters are especially preferred and are commercially available under the trade name TWEENS. A particularly preferred version of these sorbitan esters is ethoxylated sorbitan stearate having an average degree of ethoxylation per sorbitan ester of about 4, sold under the trade name TWEEN 61.

Besides the nonionic surfactant, softeners used in the present invention can additionally comprise other components. These other components typically aid in dispersing (or dissolving) the surfactant in water, modify the melting properties of the surfactant, or both. In particular, unethoxylated/unpropoxylated sorbitan esters, such as the sorbitan stearates, are not very hydrophilic, and can have melt point properties such that the onset of melting is above about 37° C. In the case of such less hydrophilic, higher melting surfactants, it is usually desirable that the softener comprise one or more components that aid in dispersing the surfactant in water, as well as lower the melting point of the surfactant.

In the case of sorbitan ester surfactants, suitable dispersion and melt point additives include condensation products of aliphatic alcohols with from about 1 to about 25 moles of ethylene oxide. The alkyl chain of the aliphatic alcohol is typically in a straight chain (linear) configuration and contains from about 8 to about 22 carbon atoms. Particularly preferred are the condensation products of alcohols having an alkyl group containing from about 11 to about 15 carbon atoms with from about 3 to about 15 moles, preferably from about 3 to about 8 moles, of ethylene oxide per mole of alcohol. Examples of such ethoxylated alcohols include the condensation products of myristyl alcohol with 7 moles of ethylene oxide per mole of alcohol, the condensation products of coconut alcohol (a mixture of fatty alcohols having alkyl chains varying in length from 10 to 14 carbon atoms) with about 5 moles of ethylene oxide. A number of suitable ethoxylated alcohols are commercially available, including TERGITOL 15-S-9 (the condensation product of $C_{11}$–$C_{15}$ linear alcohols with 9 moles of ethylene oxide), marketed by Union Carbide Corporation; KYRO EOB (condensation product of $C_{13}$–$C_{15}$ linear alcohols with 9 moles of ethylene oxide), marketed by The Procter & Gamble Co., and especially the NEODOL brand name surfactants marketed by Shell Chemical Co., in particular NEODOL 25-12 (condensation product of $C_{12}$–$C_{15}$ linear alcohols with 12 moles of ethylene oxide), NEODOL 23-6.5T (condensation product of $C_{12}$–$C_{13}$ linear alcohols with 6.5 moles of ethylene oxide that has been distilled (topped) to remove certain impurities), and NEODOL 23-3 (condensation product of $C_{12}$–$C_{13}$ linear alcohols with 3 moles of ethylene oxide).

A particularly preferred softener system for use in the present invention comprises a mixture of sorbitan stearate esters, such as GLYCOMUL-S, and an ethoxylated $C_{11}$–$C_{15}$ linear alcohol surfactant, such as NEODOL 25-12, and preferably NEODOL 23-6.5T. These preferred softeners comprise a weight ratio of sorbitan stearate esters to ethoxylated alcohol surfactant in the range of from about 1:1 to about 10:1. Preferably, these softeners comprise a weight ratio of sorbitan stearate esters to ethoxylated alcohol surfactant in the range of from about 3:1 to about 6:1. Besides dispersing the sorbitan stearate esters in water, the ethoxylated alcohol surfactant is also believed to lower the onset of melting of the sorbitan stearate esters to well below body temperature, e.g., the onset of melting is about 32° C. or less. (In the absence of the Neodol surfactant, sorbitan stearate esters typically have an onset of melting of about 37°–39° C.)

In the case of the ethoxylated/propoxylated versions of the sorbitan esters, the nonionic surfactant does not typically require an additional dispersing aid. Also, the ethoxylated/propoxylated versions of the sorbitan esters are usually sufficiently low melting, e.g., some such as the TWEEN 60 are partially liquid at room temperature (20°–25° C.). Accordingly, melting point aids are not typically required for such surfactants.

C. Treating Tissue Paper With Softener System

In the process according to the present invention, at least one surface of the dried tissue paper web is treated with the softener. Any method suitable for applying additives to the surfaces of paper webs can be used. Suitable methods include spraying, printing (e.g., flexographic printing), coating (e.g., gravure coating), or combinations of application techniques, e.g. spraying the softener on a rotating surface, such as a calender roll, that then transfers the softener to the surface of the paper web. The softener can be applied either to one surface of the dried tissue paper web, or both surfaces. For example, in the case of pattern densified tissue papers, the softener can be applied to the rougher, fabric side, the smoother, wire side, or both sides of the tissue paper web. Surprisingly, even when the softener is applied only to the smoother, wire side of the tissue paper web, the treated paper is still perceived as soft.

In the process of the present invention, the softener is typically applied from an aqueous dispersion or solution. These aqueous systems typically comprise just water and the softener, but can include other optional components. As previously noted, certain softener surfactants can be dispersed or dissolved in water without dispersing aids. However, in the case of other surfactants, such as the sorbitan stearates, the softener usually comprises a dispersing aid, as previously described. The aqueous system can additionally comprise a minor amount (e.g., up to about 0.5% by weight) of a salt, such as sodium sulfate, to lower the viscosity of the aqueous system at higher concentrations of softeners, especially those containing sorbitan stearates.

In formulating such aqueous systems, the softener is dispersed or dissolved in the water in an effective amount. What constitutes "an effective amount" of the softener in the aqueous system depends upon a number of factors, including the type of softener used, the softening effects desired, the manner of application and like factors. Basically, the softener needs to be present in amount sufficient to provide effective softening without adversely affecting the ability to apply the softener from the aqueous system to the tissue paper web. For example, relatively high concentrations of softener can make the dispersion/solution so viscous as to be difficult, or impossible, to apply the softener to the tissue paper web by conventional spray, printing or coating equipment.

In the case of sorbitan esters, such as sorbitan stearate, that require dispersing aids, the softener usually comprises from about 9 to about 30% by weight of the aqueous system. Preferably, sorbitan ester-containing softeners comprise from about 12 to about 20%, most preferably from about 12 to about 16%, by weight of the aqueous system. Where spray applications are contemplated, the aqueous system of sorbitan ester-containing softener should be formulated to have a viscosity of about 700 centipoise or less, and typically within the range of from about 200 to about 700 centipoise, when measured at the temperature of application, e.g., preferably from about 50° to about 81° F. (from about 10° to about 27° C.). Preferred aqueous systems of sorbitan ester softeners according to the present invention have viscosities in the range of from about 300 to about 500 centipoise, when measured at a temperature of from about 50° to about 81° F. (from about 10° to about 27° C.).

The effect of softener concentration and temperature on the viscosity of aqueous dispersions of sorbitan ester-containing softeners is particularly illustrated by a preferred softener system used in the present invention. This preferred softener comprises a 4:1 weight ratio of GLYCOMUL-S CG (a mixed sorbitan stearate ester) to NEODOL 23-6.5T (an ethoxylated $C_{12}$–$C_{13}$ linear alcohol). Viscosity measurements (at 24° C.) with varying concentrations of this preferred softener system are shown in Table 1 below:

TABLE 1

| Softener Conc. (% GLYCOMUL-S CG) | Viscosity (Centipoise) |
|---|---|
| 5 | 190 |
| 8 | 190 |
| 11 | 320 |
| 14 | 890 |
| 17 | 2080 |
| 20 | 3390 |

As can be seen in Table 1 above, the viscosity of aqueous dispersions of this preferred softener system rise dramatically at concentrations above about 11% GLYCOMUL-S CG. The optimum concentration of GLYCOMUL-S CG in such aqueous dispersions is typically about 12% at 24° C. This concentration is considered "optimum" in that: (a) the concentration of softener active is as high as practical to minimize the amount of water added to the tissue paper web during treatment with the softener; (b) yet is not so high so as to make the aqueous dispersion too viscous to be suitable for spray applications. If higher concentrations of GLYCOMUL-S CG are desired, a minor amount (e.g., about 0.3% by weight) of a salt, such as sodium sulfate, is preferably included in the aqueous dispersion to keep it at or below a viscosity of about 700 centipoise when measured within the previously indicated temperature range.

The effect of varying temperatures on the viscosity of aqueous dispersions of this preferred softener system (GLYCOMUL-S CG concentration of about 12%) are shown in Table 2 below:

TABLE 2

| Temperature (°C.) | Viscosity (Centipoise) |
|---|---|
| 6 | 650 |
| 10 | 400 |
| 16 | 280 |
| 22 | 310 |
| 27 | 420 |
| 33 | 2820 |
| 38 | 2890 |
| 43 | 1520 |
| 49 | 260 |
| 52 | 50 |

As can be seen in Table 2 above, varying the temperature of the aqueous dispersion of this preferred softener system can also have a significant effect on its viscosity. The viscosity is fairly constant at temperatures of from about 10° to about 27° C., then rises dramatically at a temperature of about 33° C., and then falls equally dramatically at a temperature of about 49° C. due to phase separation of the GLYCOMUL-S CG and water. Accordingly, for spray applications, the temperature of the aqueous dispersion of this preferred softener system, at its optimum softener active concentration, is preferably between about 10° C. and about 27° C.

In the case of ethoxylated/propoxylated sorbitan esters, such as TWEEN 61, that can be dispersed or dissolved in water without other aids, the softener usually comprises from about 10 to about 50% by weight of the aqueous system. The preferred ethoxylated sorbitan ester-containing softeners (e.g. TWEEN 61) preferably comprise from about 20 to about 40% by weight, most preferably from about 25 to about 35% by weight, of the aqueous system, typically as an aqueous solution. Where spray applications are contemplated, the aqueous systems comprising these preferred ethoxylated sorbitan ester softeners should be formulated to have a viscosity of about 700 centipoise or less, and typically in the range of from about 20 to about 700 centipoise, as measured at the temperature of application, e.g., preferably from about 130° to about 150° F. (from about 54.4° to about 65.6 ° C.), such as in the case of TWEEN 61 which melts and dissolves in water within this temperature range. Preferred aqueous systems of these preferred ethoxylated sorbitan ester softeners have viscosities in the range of from about 20 to about 500 centipoise, when measured at a temperature of from about 130° to about 150° F. (from about 54.4° to about 65.6° C.).

In the process of the present invention, the softener is applied to the tissue paper web after it has been dried, i.e. the application of softener is a "dry web" addition method. When dried, the tissue paper usually has a moisture content of about 10% or less, preferably about 6% or less, most preferably about 3% or less. In commercial papermaking systems, treatment with the softener usually occurs after the tissue paper web has been dried by, and then creped from, a Yankee dryer. As previously noted, if added to a wet paper web, nonionic surfactants, such as the sorbitan stearates, have a greater potential to migrate to the interior of the web and completely coat the fibers. This can cause increased fiber debonding that could lead to a further reduction in tensile strength of the paper, as well as affect paper wettability if the surfactant is a less hydrophilic one, as are sorbitan stearates.

Addition of such nonionic surfactants to wet webs is particularly not desirable in commercial papermaking systems. Such addition can interfere with the glue coating on a Yankee dryer, and can also cause skip crepe and loss in sheet control. Accordingly, treatment of the tissue paper web with the softener after it has been dried, as in the present invention, avoids these potential problems of wet web addition, particularly in commercial papermaking systems.

In the process of the present invention, the softener is applied in an amount of from about 0.1 to about 3% by weight of the tissue paper web. Preferably, the softener is applied in an amount of from about 0.2 to about 0.8% by weight of the tissue paper web. Such relatively low levels of softener are adequate to impart enhanced softness to the tissue paper, yet do not coat the surface of the tissue paper web to such an extent that strength, absorbency, and particularly wettability, are substantially affected. The softener is also typically applied to the surface of the tissue paper web in a nonuniform manner. By "nonuniform" is meant that the amount, pattern of distribution, etc. of the softener can vary over the surface of the paper. For example, some portions of the surface of the tissue paper web can have greater or lesser amounts of softener, including portions of the surface that do not have any softener on it.

This typical nonuniformity of the softener on the tissue paper web is believed to be due, in large part, to the manner in which the softener is applied to the surface thereof. For example, in preferred treatment methods where aqueous dispersions or solutions of the softener are sprayed, the softener is applied as a regular, or typically irregular, pattern of softener droplets on the surface of the tissue paper web. This nonuniform application of softener is also believed to avoid substantial adverse effects on the strength and absorbency of the tissue paper, and in particular its wettability, as well as reducing the level of softener required to provide effective softening of the tissue paper. The benefits of nonuniform application are believed to be especially important when the softener comprises less hydrophilic nonionic surfactants, in particular sorbitan esters such as the sorbitan stearates.

The softener can be applied to the tissue paper web at any point after it has been dried. For example, the softener can be applied to the tissue paper web after it has been creped from a Yankee dryer, but prior to calendering, i.e., before being passed through calender rolls. The softener can also be applied to the paper web after it has passed through such calender rolls and prior to being wound up on a parent roll. Although not usually preferred, the softener can also be applied to the tissue paper as it is being unwound from a parent roll and prior to being wound up on a smaller, finished paper product roll.

Figure 2:
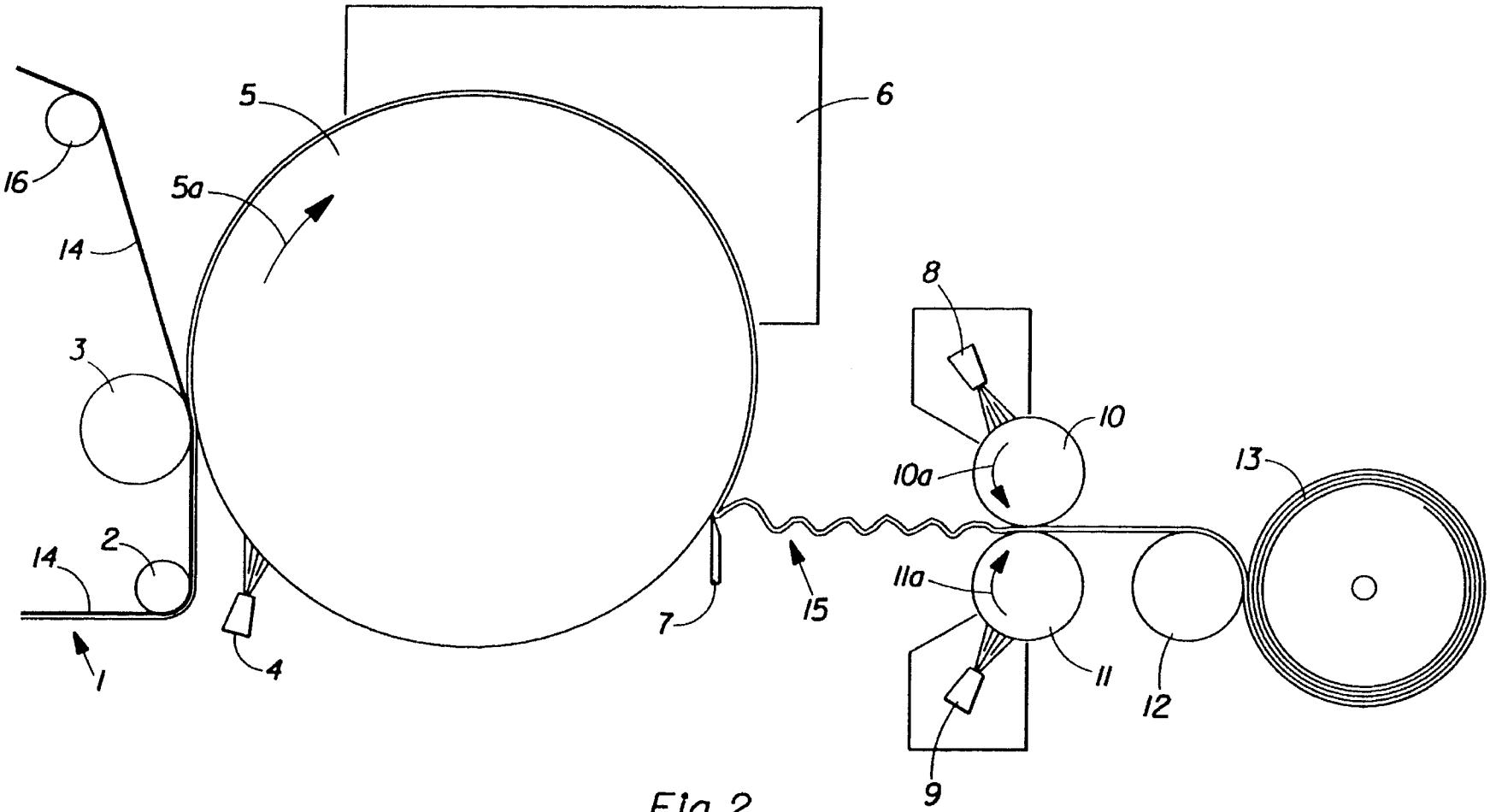
FIG. 2 is a schematic representation illustrating a preferred embodiment of the process for softening tissue webs according to the present invention.

FIG. 2 illustrates a preferred method of applying the aqueous dispersions or solutions of softener to the dry tissue paper web. Referring to FIG. 2, wet tissue web 1 is carried on imprinting fabric 14 past turning roll 2 and then transferred to a Yankee dryer 5 (rotating in the direction indicated by arrow 5*a*) by the action of pressure roll 3 while imprinting fabric 14 travels past turning roll 16. The paper web is adhesively secured to the cylindrical surface of dryer 5 by an adhesive supplied from spray applicator 4. Drying is completed by steam heating dryer 5 and by hot air heated and circulated through drying hood 6 by means not shown. The web is then dry creped from dryer 5 by doctor blade 7, after which it becomes designated as dried creped paper sheet 15.

Paper sheet 15 then passes between a pair of calender rolls 10 and 11. An aqueous dispersion or solution of softener is sprayed onto upper calender roll 10 and/or lower calender roll 11 by spray applicators 8 and 9, respectively, depending on whether one or both sides of paper sheet 15 is to be treated with softener. The aqueous dispersion or solution of softener is applied by sprayers 8 and 9 to the surface of upper calender roll 10 and/or lower calender roll 11 as a pattern of droplets. These droplets containing the softener are then transferred by upper calender roll 10 and/or lower calender roll 11, (rotating in the direction indicated by arrows 10*a* and 11*a*) to the upper and/or lower surface of paper sheet 15. In the case of pattern-densified papers, the upper surface of paper sheet 15 usually corresponds to the rougher, fabric side of the paper, while the lower surface corresponds to the smoother, wire side of the paper. The upper calender roll 10 and/or lower calender roll 11 applies this pattern of softener droplets to the upper and/or lower surface of paper sheet 15. Softener-treated paper sheet 15 then passes over a circumferential portion of reel 12, and is then wound up onto parent roll 13.

One particular advantage of the embodiment shown in FIG. 2 is the ability to heat upper calender roll 10 and/or lower calender roll 11. By heating calender rolls 10 and/or 11, some of the water in the aqueous dispersion or solution of softener is evaporated. This means the pattern of droplets contain more concentrated amounts of the softener. As a result, a particularly effective amount of the softener is applied to the surface(s) of the tissue paper, but tends not to migrate to the interior of the paper web because of the reduced amount of water.

D. Softened Tissue Paper

Tissue paper softened according to the present invention, especially facial and toilet tissue, has a soft and velvet-like feel due to the softener applied to one or both surfaces of the paper. This softness can be evaluated by subjective testing that obtains what are referred to as Panel Score Units (PSU) where a number of practiced softness judges are asked to rate the relative softness of a plurality of paired samples. The data are analyzed by a statistical method known as a paired comparison analysis. In this method, pairs of samples are first identified as such. Then, the pairs of samples are judged one pair at a time by each judge: one sample of each pair being designated X and the other Y. Briefly, each X sample is graded against its paired Y sample as follows:

1. a grade of zero is given if X and Y are judged to be equally soft.
2. a grade of plus one is given if X is judged to maybe be a little softer than Y, and a grade of minus one is given if Y is judged to maybe be a little softer than X;
3. a grade of plus two is given if X is judged to surely be a little softer than Y, and a grade of minus two is given if Y is judged to surely be a little softer than X;
4. a grade of plus three is given to X if it is judged to be a lot softer than Y, and a grade of minus three is given if Y is judged to be a lot softer than X; and lastly,
5. a grade of plus four is given to X if it is judged to be a whole lot softer than Y, and a grade of minus 4 is given if Y is judged to be a whole lot softer than X.

The resulting data from all judges and all sample pairs are then pair-averaged and rank ordered according to their grades. Then, the rank is shifted up or down in value as required to give a zero PSU value to whichever sample is chosen to be the zero-base standard. The other samples then have plus or minus values as determined by their relative grades with respect to the zero base standard. A difference of about 0.2 PSU usually represents a significance difference in subjectively perceived softness. Relative to the unsoftened tissue paper, tissue paper softened according to the present invention typically is about 0.5 PSU or greater in softness.

An important aspect of the present invention is that this softness enhancement can be achieved while other desired properties in the tissue paper are maintained, such as by compensating mechanical processing (e.g. pulp refining) and/or the use of chemical additives (e.g., starch binders). One such property is the total dry tensile strength of the tissue paper. As used herein, "total tensile strength" refers to the sum of the machine and cross-machine breaking strengths in grams per inch of the sample width. Tissue papers softened according to the present invention typically have total dry tensile strengths of at least about 360 g/in., with typical ranges of from about 360 to about 450 g/in. for single-ply facial/toilet tissues, from about 400 to about 500 g/in. for two-ply facial/toilet tissues, and from about 1000 to 1800 g/in. for towel products.

Another property that is important for tissue paper softened according to the present invention is its absorbency or wettability, as reflected by its hydrophilicity. Hydrophilicity of tissue paper refers, in general, to the propensity of the tissue paper to be wetted with water. Hydrophilicity of tissue paper can be quantified somewhat by determining the period of time required for dry tissue paper to become completely wetted with water. This period of time is referred to as the "wetting" (or "sinking") time. In order to provide a consistent and repeatable test for wetting time, the following procedure can be used for wetting time determinations: first, a paper sample (the environmental conditions for testing of paper samples are 23±1° C. and 50±2% RH. as specified in TAPPI Method T 402), approximately 2.5 inches×3.0 inches (about 6.4 cm×7.6 cm) is cut from an 8 sheet thick stack of conditioned paper sheets; second, the cut 8 sheet thick paper sample is placed on the surface of 2500 ml. of distilled water at 23±1° C. and a timer is simultaneously started as the bottom sheet of the sample touches the water; third, the timer is stopped and read when wetting of the paper sample is completed, i.e. when the top sheet of the sample becomes completely wetted. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

The hydrophilicity of tissue paper can, of course, be determined immediately after manufacture. However, substantial increases in hydrophobicity can occur during the first two weeks after the tissue paper is made: i.e. after the paper has aged two (2) weeks following its manufacture. Thus, the above stated wetting times are preferably measured at the end of such two week period. Accordingly, wetting times measured at the end of a two week aging period at room temperature are referred to as "two week wetting times."

Tissue papers softened according to the present invention should also desirably have relatively low lint properties. As used herein, "lint" typically refers to dust-like paper particles that are either unadhered, or loosely adhered, to the surface of the paper. The generation of lint is usually an indication of a certain amount of debonding of the paper fibers, as well as other factors such as fiber length, headbox layering, etc. In order to reduce lint formation, tissue paper softened according to the present invention typically requires the addition of starch binders to the papermaking fibers, as previously described in part A of this application.

As previously noted, the present invention is particularly useful in enhancing the softness of pattern densified tissue papers, in particular those having pattern designs. These pattern densified papers are typically characterized by a relatively low density (grams/cc) and a relatively low basis weight (g/cm$^2$). Pattern densified tissue papers according to the present invention typically have a density of about 0.60 g/cc or less, and a basis weight between about 10 g/m$^2$ and about 65 g/m$^2$. Preferably, these pattern densified papers have a density of about 0.3 g/cc or less (most preferably between about 0.04 g/cc and about 0.2 g/cc), and a basis weight of about 40 g/m$^2$ or less. See Column 13, lines 61–67, of U.S. Pat. No. 5,059,282 (Ampulski et al), issued Oct. 22, 1991, which describes how the density of paper is measured.

Specific Illustrations of the Preparation of Softened Tissue Paper according to the Present Invention The following are specific illustrations of the softening of tissue paper in accordance with the present invention:

EXAMPLE 1

A. Preparation of Aqueous Dispersion of Softener

An aqueous dispersion of softener is prepared from GLYCOMUL-S CG (a mixed sorbitan stearate ester surfactant made by Lonza, Inc.), NEODOL 23-6.5T (a 20% solution of an ethoxylated $C_{12}$–$C_{13}$ linear alcohol dispersing surfactant and wetting agent made by Shell Chemical Company), DOW 65 Additive (a silicone polymer foam suppressant made by Dow Corning Corporation), and distilled water. The composition of GLYCOMUL-S CG is shown in Table 3 below:

TABLE 3

| Composition | Weight % |
|---|---|
| Monoester | 22.6 |
| Diester | 39.3 |
| Triester | 22.9 |
| Tetraester | 7.1 |
| Fatty Acid (total) | 3.1 |
| Polyol | 4.3 |
| Other | 0.5 |

In preparing the aqueous dispersion of softener, the components are added to a stainless steel reactor equipped with temperature controlled heating and mechanical stirring in the following weight percentages shown in Table 4 below:

TABLE 4

| Component | Weight % |
|---|---|
| NEODOL 23.-6.5T* | 3.2 |
| GLYCOMUL-S CG | 11.9 |
| DOW 65 Additive | 0.8 |
| Water | 84.1 |

*surfactant active only

The contents of the reactor are heated to 75° C. with slow stirring and then allowed to cool to 49° C. or below with continuous, moderate stirring. (Two visually distinct phases will form if the stirring is stopped while the dispersion is above 49° C.) The viscosity of the resulting aqueous dispersion of softener, when measured at 24° C. after vigorous stirring, should be between 200 and 700 centipoise. If the viscosity of the dispersion is higher, distilled water can be added in small increments until the viscosity is within the appropriate range.

B. Treating Tissue Paper with Aqueous Dispersion of Softener

A pilot scale Fourdrinier papermaking machine is used. The machine has a layered headbox with a top chamber, a center chamber, and a bottom chamber. A first fibrous slurry comprised primarily of short papermaking fibers (Eucalyptus Hardwood Kraft) is pumped through the top and bottom headbox chambers. Simultaneously, a second fibrous slurry comprised primarily of long papermaking fibers (Northern Softwood Kraft) is pumped through the center headbox chamber and delivered in a superposed relationship onto the Fourdrinier wire to form a 3-layer embryonic web. The first slurry has a fiber consistency of about 0.11%, while the second slurry has a fiber consistency of about 0.15%. The embryonic web is dewatered through the Fourdrinier wire (5-shed, satin weave configuration having 84 machine-direction and 76 cross-machine-direction monofilaments per inch, respectively), the dewatering being assisted by deflector and vacuum boxes.

The wet embryonic web is transferred from the Fourdrinier wire to a carrier fabric similar to that shown in FIG. 10 of U.S. Pat. No. 4,637,859, but with an aesthetically pleasing macropattern of rose petals superimposed on the regular micropattern of the carrier fabric. At the point of transfer to the carrier fabric, the web has a fiber consistency of about 22%. The wet web is moved by the carrier fabric past a vacuum dewatering box, through blow-through predryers, and then transferred onto a Yankee dryer. The web has a fiber consistency of about 27% after the vacuum dewatering box, and about 65% after the predryers and prior to transfer onto the Yankee dryer.

The web is adhered to the surface of the Yankee dryer by a creping adhesive comprising a 0.25% aqueous solution of polyvinyl alcohol that is applied to the surface of the dryer. The Yankee dryer is operated at a temperature of about 177° C. and a surface speed of about 244 meters per minute. The dried web is then creped from the Yankee dryer with a doctor blade having a bevel angle of about 24° and positioned with respect to the dryer to provide an impact angle of about 83° . Prior to creping, the fiber consistency of the dried web is increased to an estimated 99%.

The dried, creped web (moisture content of 1%) is then passed between a pair of calender rolls biased together at roll weight and operated at surface speeds of 201 meters per minute. The lower, hard rubber calender roll is sprayed with the previously prepared aqueous dispersion of softener by four 0.71 mm diameter spray nozzles aligned in a linear fashion with a spacing of about 10 cm between nozzles. The volumetric flow rate of the aqueous dispersion of softener through each nozzle is about 0.37 liters per minute per cross-direction meter. The aqueous dispersion of softener is sprayed onto this lower calendar roll as a pattern of droplets that are then transferred to the smoother, wire side of the dried, creped web by direct pressure transfer. The retention rate of the softener on the dried web is, in general, about 67%. The resulting softened tissue paper has a basis weight of about 30 grams/m$^2$, a density of about 0.10 grams/cc, and about 0.6% softener (80% GLYCOMUL-S CG) by weight of the dry paper.

EXAMPLE 2

Tissue papers were treated with varying levels of softener using the procedure described in Example 1. The properties of these softened papers are shown in Table 5 below:

TABLE 5

| Softener* Level(Wt. %) | Softness (PSU) | Total Tensile(g/in.) | Sink Time(Sec) |
|---|---|---|---|
| 0 | 0 | 402 | 0.8 |
| 0.46 | 1.1 | 408 | 1.7 |
| 0.53 | 1.3 | 395 | 3.3 |
| 0.75 | 1.2 | 428 | 2.4 |

*80% GLYCOMUL-S CG

EXAMPLE 3

A. Preparation of Aqueous Solution of Softener

An aqueous solution of softener is prepared from TWEEN 61 (a mixed sorbitan stearate ester having an average degree of ethoxylation of 4 made by ICI Americas, Inc.), DOW 65 Additive, and distilled water. In preparing the aqueous solution of softener, the components are added to a stainless steel reactor equipped with temperature controlled heating and mechanical stirring in the following weight percentages shown in Table 6 below:

TABLE 6

| Component | Weight % |
|---|---|
| TWEEN 61 | 40.0 |
| DOW 65 Additive | 0.4 |
| Distilled Water | 59.6 |

The contents of the reactor are heated to 75° C. with slow stirring and then allowed to cool to 60° C.±5° C. with moderate stirring. The viscosity of the resulting aqueous solution of softener, measured at 60° C., should be between 20 and 700 centipoise. If the viscosity of the solution is higher, distilled water can be added in small increments until the viscosity is within the appropriate range.

B. Treating Tissue Paper with Aqueous Solution of Softener

A dried, creped paper web is prepared similar to Example 1. As this dried, creped web passes between the pair of calender rolls, the lower, hard rubber calender roll is sprayed with the aqueous solution of softener at a flow rate adjusted to provide a pattern of TWEEN 61 softener droplets that are then transferred to the smoother, wire side of the dried creped web. About 0.5% TWEEN 61 by weight of the dry paper is retained. The resulting softened tissue paper has a velvety, flannel-like feel with enhanced tactile softness.

What is claimed is:

1. A process for softening a tissue paper web which comprises the step of treating at least one surface of a dry tissue paper web with a nonionic softener comprising a nonionic surfactant selected from the group consisting of s sorbitan esters, ethoxylated sorbitan esters, propoxylated sorbitan esters, mixed ethoxylated/propoxylated sorbitan esters, and mixtures thereof, in a manner such that the softener is applied to said at least one surface in an amount of from about 0.1 to about 3% by weight of the dry tissue paper web.

2. The process of claim 1 wherein the dry tissue paper web has a moisture content of about 10% or less and wherein the softener is applied nonuniformly to said at least one surface.

3. The process of claim 2 wherein the softener is applied from an aqueous system thereof as a pattern of softener droplets to said at least one surface.

4. The process of claim 3 wherein the softener is applied to said at least one surface in an amount of from about 0.2 to about 0.8% by weight of the dry tissue paper web.

5. The process of claim 2 wherein the softener is applied to said at least one surface after creping and prior to calendering of the dry tissue paper web.

6. The process of claim 2 wherein the dry tissue paper web is a pattern densified tissue paper having a moisture content of about 6% or less, a basis weight between about 10 $g/m^2$ and about 65 $g/m^2$ and a density of about 0.6 g/cc or less.

7. The process of claim 6 wherein said at least one surface is the smoother side of the pattern densified tissue paper.

8. The process of claim 1 wherein the predominant melting phase of the softener has an onset of melting of about 37° C. or less.

9. The process of claim 8 wherein the nonionic surfactant is a sorbitan ester of a $C_{12}$–$C_{22}$ fatty acid.

10. The process of claim 9 wherein the sorbitan ester is selected from the group consisting of sorbitan laurates, sorbitan myristates, sorbitan palmitates, sorbitan stearates, sorbitan behenates and mixtures thereof.

11. The process of claim 10 wherein the softener further comprises an ethoxylated alcohol having a straight alkyl chain of from about 8 to about 22 carbon atoms and from about 1 to about 25 moles of ethylene oxide.

12. The process of claim 11 wherein the softener comprises a mixture of sorbitan stearate esters and an ethoxylated alcohol having a straight alkyl chain of from about 11 to about 15 carbon atoms and from about 3 to about 15 moles of ethylene oxide, in a weight ratio of sorbitan stearate esters to ethoxylated alcohol of from about 1:1 to about 10:1.

13. The process of claim 12 wherein the weight ratio of sorbitan stearate esters to ethoxylated alcohol is from about 3:1 to about 6:1 and wherein the ethoxylated alcohol has a degree of ethoxylation of from about 3 to about 8.

14. The process of claim 8 wherein the nonionic surfactant is an ethoxylated sorbitan ester of a $C_{12}$–$C_{22}$ fatty acid having an average degree of ethoxylation of from 1 to about 20.

15. The process of claim 11 wherein the ethoxylated sorbitan ester is selected from the group consisting of ethoxylated sorbitan laurates, ethoxylated sorbitan myristates, ethoxylated sorbitan palmitates, ethoxylated sorbitan stearates, ethoxylated sorbitan behenates and mixtures thereof, the ethoxylated sorbitan ester having an average degree of ethoxylation of from about 2 to about 10.

16. The process of claim 15 wherein the ethoxylated sorbitan ester is selected from the group consisting of ethoxylated sorbitan stearates having an average degree of ethoxylation of from about 2 to about 6.

17. A process for softening a pattern densified tissue paper web, which comprises the steps of:

(a) providing a patterned densified tissue paper web having:
  (1) a moisture content of about 6% or less;
  (2) a basis weight between about 10 $g/m^2$ and about 65 $g/m^2$; and
  (3) a density of about 0.6 g/cc or less; and
  (4) from about 0.01 to about 2% starch binder by weight of the paper web;

(b) providing an aqueous system comprising an effective amount of a nonionic softener comprising a nonionic surfactant selected from the group consisting of sorbitan esters of $C_{12}$–$C_{22}$ saturated fatty acids, ethoxylated sorbitan esters of said fatty acids having an average degree of ethoxylation of from about 2 to about 10, and mixtures thereof, the predominant melting phase of the softener having an onset of melting at or below about 35° C.; and (c) applying the softener from the aqueous system thereof to at least one surface of the paper web in an amount of from about 0.1 to about 3% by weight of the paper web.

18. The process of claim 17 wherein the softener is applied to said at least one surface after creping and prior to calendering of the paper web.

19. The process of claim 18 wherein the aqueous system is sprayed as a pattern of softener droplets onto the surface of a rotating calender roll that then transfers the softener droplets to said at least one surface.

20. The process of claim 19 wherein the softener is applied to said at least one surface in an amount of from about 0.2 to about 0.8% by weight of the paper web.

21. The process of claim 20 wherein the paper web of step (a) has a moisture content of about 3% or less, a basis weight of about 40 $g/m^2$ or less and a density of about 0.3 g/cc or less.

22. The process of claim 21 wherein said at least one surface is the smoother side of the paper web.

23. The process of claim 17 wherein the nonionic surfactant is selected from the group consisting of sorbitan laurates, sorbitan myristates, sorbitan palmitates, sorbitan stearates, sorbitan behenates and mixtures thereof.

24. The process of claim 23 wherein the aqueous system comprises from about 9 to about 30% by weight softener and has a viscosity of from about 200 to about 700 centipoise at a temperature from about 50° to about 81° F. (from about 10° to about 27° C.).

25. The process of claim 24 wherein the softener further comprises an ethoxylated alcohol having a straight alkyl chain of from about 8 to about 22 carbon atoms and from about 1 to about 25 moles of ethylene oxide.

26. The process of claim 25 wherein the softener comprises a mixture of sorbitan stearate esters and an ethoxylated alcohol having a straight alkyl chain of from about 11 to about 15 carbon atoms and from about 3 to about 15 moles of ethylene oxide, in a weight ratio of sorbitan stearate esters to ethoxylated alcohol of from about 1:1 to about 10:1.

27. The process of claim 26 wherein the weight ratio of sorbitan stearate esters to ethoxylated alcohol is from about 3:1 to about 6:1 and wherein the ethoxylated alcohol has a degree of ethoxylation of from about 3 to about 8.

28. The process of claim 17 wherein the nonionic surfactant is an ethoxylated sorbitan ester selected from the group consisting of ethoxylated sorbitan laurates, ethoxylated sorbitan myristates, ethoxylated sorbitan palmitates, ethoxylated sorbitan stearates, ethoxylated sorbitan behenates and mixtures thereof.

29. The process of claim 28 wherein the aqueous system comprises from about 10 to about 50% by weight softener and has a viscosity of from about 20 to about 700 centipoise at a temperature from about 130° to about 150° F. (from about 54.4° to about 65.6° C.).

30. The process of claim 29 wherein the ethoxylated sorbitan ester is selected from the group consisting of ethoxylated sorbitan stearates having an average degree of ethoxylation of from about 2 to about 6.

* * * * *